US008808022B2

(12) United States Patent
Terasaka

(10) Patent No.: US 8,808,022 B2
(45) Date of Patent: Aug. 19, 2014

(54) CONNECTOR STRUCTURE

(75) Inventor: Yutaka Terasaka, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/813,698

(22) PCT Filed: Jul. 29, 2011

(86) PCT No.: PCT/JP2011/067504
§ 371 (c)(1),
(2), (4) Date: Feb. 1, 2013

(87) PCT Pub. No.: WO2012/026287
PCT Pub. Date: Mar. 1, 2012

(65) Prior Publication Data

US 2013/0130536 A1 May 23, 2013

(30) Foreign Application Priority Data

Aug. 27, 2010 (JP) ..... 2010-190480

(51) Int. Cl.
*H01R 4/48* (2006.01)
*H01R 13/15* (2006.01)
*H01R 12/79* (2011.01)
*H01R 12/55* (2011.01)
*H01R 13/627* (2006.01)

(52) U.S. Cl.
CPC *H01R 4/48* (2013.01); *H01R 12/55* (2013.01); *H01R 12/79* (2013.01); *H01R 13/6272* (2013.01)
USPC ..... 439/350; 439/495; 439/260

(58) Field of Classification Search
USPC ..... 439/626, 92–108
See application file for complete search history.

(56) References Cited

U.S. PATENT DOCUMENTS 3,149,897 A * 9/1964 Martineck ..... 439/495
5,354,214 A * 10/1994 Aso et al. ..... 439/495
6,315,602 B1 * 11/2001 Miura et al. ..... 439/495

(Continued)

FOREIGN PATENT DOCUMENTS

JP 59-28985 U 2/1984
JP 07-192822 A 7/1995

(Continued)

OTHER PUBLICATIONS

International Search Report (PCT/ISA/210), dated Oct. 18, 2011, issued by the International Searching Authority in counterpart International Patent Application No. PCT/JP2011/067504.

(Continued)

*Primary Examiner* — Briggitte R Hammond
(74) *Attorney, Agent, or Firm* — Sughrue Mion, PLLC

(57) ABSTRACT

A connector structure includes a clamping terminal including a first terminal part and a second terminal part which project from a terminal base, and an insertion space which is formed between the first terminal part and the second terminal part. An insertion member is formed with a fixing slope part, which is inclined with respect to an insertion direction, at a front end part of the insertion member in the insertion direction. A conductor exposed from the circuit body is fixed to the fixing slope part. A connecting protrusion is formed on one of the first terminal part and the second terminal part. The connecting protrusion is formed with a connecting slope part which is inclined in accordance with the fixing slope part.

4 Claims, 5 Drawing Sheets

(56) References Cited

U.S. PATENT DOCUMENTS

| | | | | |
|---|---|---|---|---|
| 6,315,603 | B1 * | 11/2001 | Miura et al. | 439/495 |
| 6,739,902 | B2 * | 5/2004 | Miyazawa et al. | 439/495 |
| 7,025,613 | B2 * | 4/2006 | Satou | 439/260 |
| 8,128,425 | B2 * | 3/2012 | Takahashi et al. | 439/260 |

FOREIGN PATENT DOCUMENTS

| | | | |
|---|---|---|---|
| JP | 2001-351706 | A | 12/2001 |
| JP | 2003-45558 | A | 2/2003 |
| JP | 2004-39479 | A | 2/2004 |

OTHER PUBLICATIONS

Written Opinion (PCT/ISA/237), dated Oct. 18, 2011, issued by the International Searching Authority in counterpart International Patent Application No. PCT/JP2011/067504.

Office Action dated Apr. 2, 2014, issued by the Korean Intellectual Property Office in counterpart Korean Application No. 10-2013-7005072.

* cited by examiner

CONNECTOR STRUCTURE

TECHNICAL FIELD

The present invention is related to a connector structure which includes a housing, a clamping terminal, an insertion member and a circuit body.

BACKGROUND ART

A connector structure disclosed in the PTL 1 is a structure provided with a housing, a clamping terminal, a slider, a flat cable and a cable pressing member. According to the connector structure of the PTL 1, the clamping terminal is included as a terminal which is accommodated in the housing. The slider is included as an insertion member. The flat cable is included as a circuit body. The cable pressing member is included to be fitted with the slider and to fix the flat cable.

The flat cable is fixed to a bottom surface of the slider by the cable pressing member. The slider is inserted between an upper terminal part and a lower terminal part of the clamping terminal accommodated in the housing. When the slider is inserted, since the flat cable is in the above-mentioned fixed state, the cable conductor contacts with the lower terminal part to made an electric connection.

When the slider in a state of fixing the flat cable is inserted to the clamping terminal, the upper terminal part and the lower terminal part are bent in a separating direction (pushed open) with the insertion. While a clamping is performed by a reaction force of this bending, the connection of the lower terminal part and the cable conductor is maintained.

The connection of the lower terminal part and the cable conductor is accomplished when top parts of projections formed on the lower terminal part are in a line contact or point contact with the cable conductor.

CITATION LIST

Patent Literatures

[PTL 1] JP-A-2003-45558

SUMMARY OF INVENTION

Technical Problem

In the above-mentioned related art, the top parts of the projections on the lower terminal part of the clamping terminal are in a line contact or point contact with the cable conductor of the flat cable to accomplish the connection. However, since it is preferable that a contact area is increased in order to ensure a good connection, there is a problem that this is not possible.

In order to downsize the connector structure, it is effective to shorten the clamping terminal and the housing in the insertion direction of the slider. However, when the downsizing is expected, there is a problem that it becomes more difficult to increase the above-mentioned contact area.

The present invention is made in view of the above-mentioned situations, and the object of the present invention is to provide a connector structure which makes it possible to downsize while the contact area for electric connection can be ensured.

Solution to Problem

The above object of the present invention is achieved with the following constructions.

(1) A connector structure comprising:

a clamping terminal including a first terminal part and a second terminal part which project from a terminal base, and an insertion space which is formed between the first terminal part and the second terminal part;

a housing including a fitting part which accommodates the clamping terminal;

an insertion member configured to be inserted into the insertion space through the fitting part; and a circuit body, fixed to the insertion member, and configured to be electrically connected to one of the first terminal part and the second terminal part in a state where the insertion member is inserted into the insertion space, wherein the insertion member is formed with a fixing slope part, which is inclined with respect to an insertion direction, at a front end part of the insertion member in the insertion direction, a conductor exposed from the circuit body is fixed to the fixing slope part, a connecting protrusion is formed on one of the first terminal part and the second terminal part, and the connecting protrusion is formed with a connecting slope part which is inclined in accordance with the fixing slope part.

According to the connector structure of the above construction (1), since there are the fixing slope part and the connecting slope part which are inclined with respect to the insertion direction of the insertion member, and since the conductor exposed from the circuit body is fixed to the fixing slope part, the conductor of the circuit body can be made to be in a surface contact with the connecting slope part of the connecting protrusion with the insertion of the insertion member. According to the above construction (1), since there are the fixing slope part and the connecting slope part which are inclined with respect to the insertion direction of the insertion member, the housing and the clamping terminal can be formed to be shorter in the above-mentioned insertion direction. Therefore, an effect is achieved that a connector structure can be provided which makes it possible to downsize while the contact area related to electric connection can be ensured.

(2) The connector structure according to the above construction (1), wherein the connecting slope part is formed with a plurality of projections.

According to the connector structure of the above construction (2), when the conductor of the circuit body is made to be in a surface contact with the connecting slope part of the connecting protrusion with the insertion of the insertion member, at this time, microscopically, many contact parts can be ensured by a plurality of projections formed on the connecting slope part. Therefore, an effect is achieved that a good connection can be ensured.

(3) The connector structure according to the above construction (1) or (2), wherein a positioning protrusion is formed on the other one of the first terminal part and the second terminal part, and the positioning protrusion is located at a position farther than the connecting slope part with respect to the insertion member.

According to the connector structure of the above construction (3), since the positioning protrusion is formed at the clamping terminal, it becomes possible to determine the insertion position of the insertion member easily. Therefore, effects are achieved that a good connection can be ensured and that the insertion position of the insertion member can be determined.

BRIEF DESCRIPTION OF DRAWINGS

FIG. 5A is a figure which shows an electric connection state, and FIG. 5B is a figure of a connecting slope part.

DESCRIPTION OF EMBODIMENTS

The connector structure of the present invention is constructed by including a clamping terminal which has a first terminal part and a second terminal part, a housing which accommodates the clamping terminal, an insertion member which is inserted in the clamping terminal through a fitting part of the housing, and a circuit body which is fixed to the insertion member. In the connector structure, the electric connection of the clamping terminal and the circuit body which is fixed to the insertion member is made by the contact of surfaces which are inclined with respect to an insertion direction of the insertion member.

In particular, a connecting protrusion is formed on either of the first terminal part and the second terminal part in the clamping terminal. A fixing slope part, which is inclined with respect to an insertion direction of the insertion member, is formed at an insertion front end part of the insertion member. A conductor exposed from the circuit body is fixed to the fixing slope part. A connecting slope part which is inclined in accordance with the fixing slope part is formed at the connecting protrusion.

Figure 1:
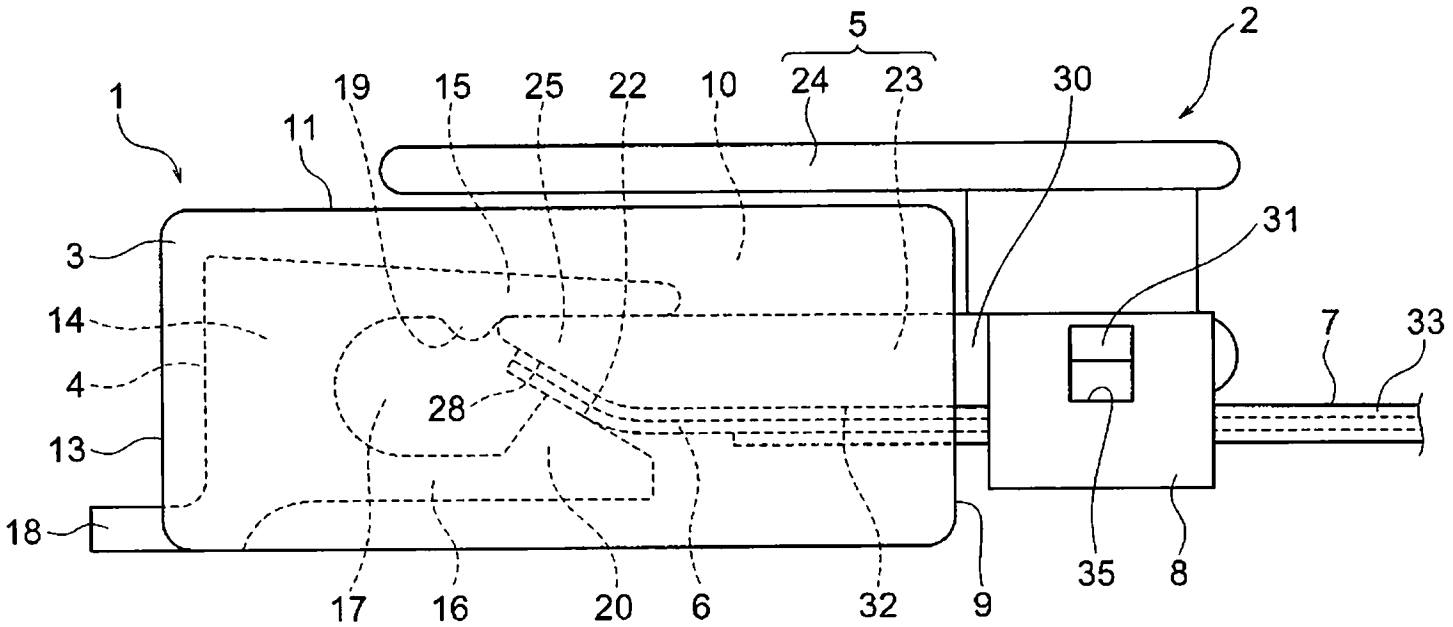
FIG. 1 is a configuration figure which shows a connector structure of the present invention (a first embodiment).
Figure 2A:
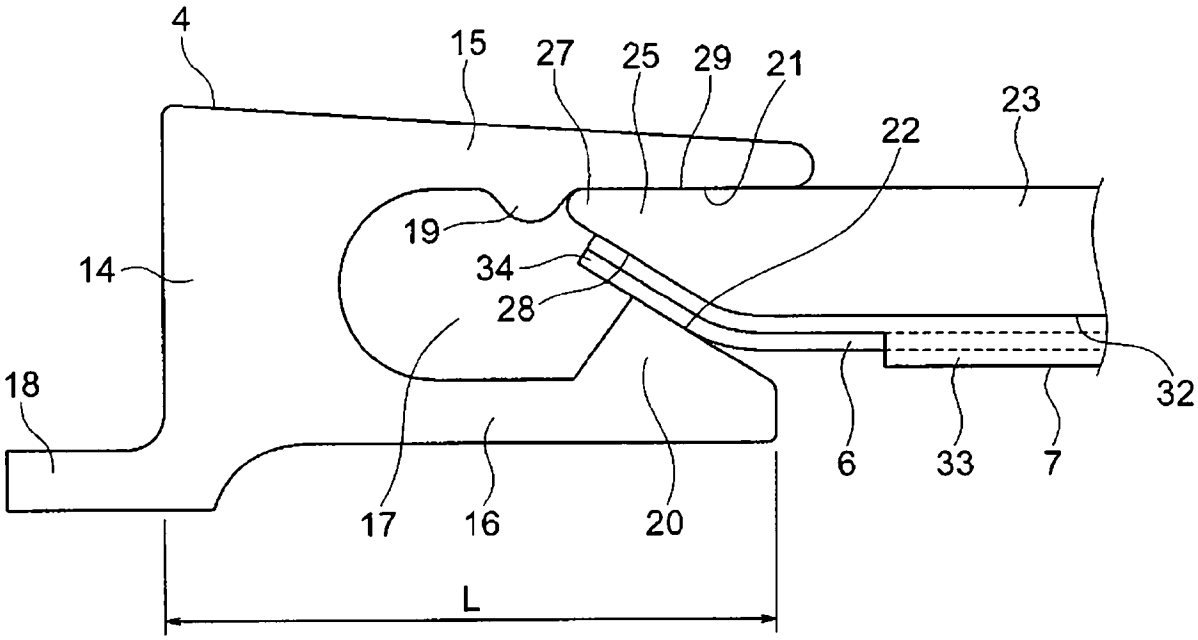
FIG. 2A is a figure which shows an electric connection state.
Figure 2B:
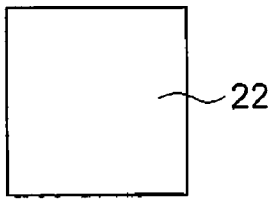
FIG. 2B is a figure of a connecting slope part.
Figure 3A:
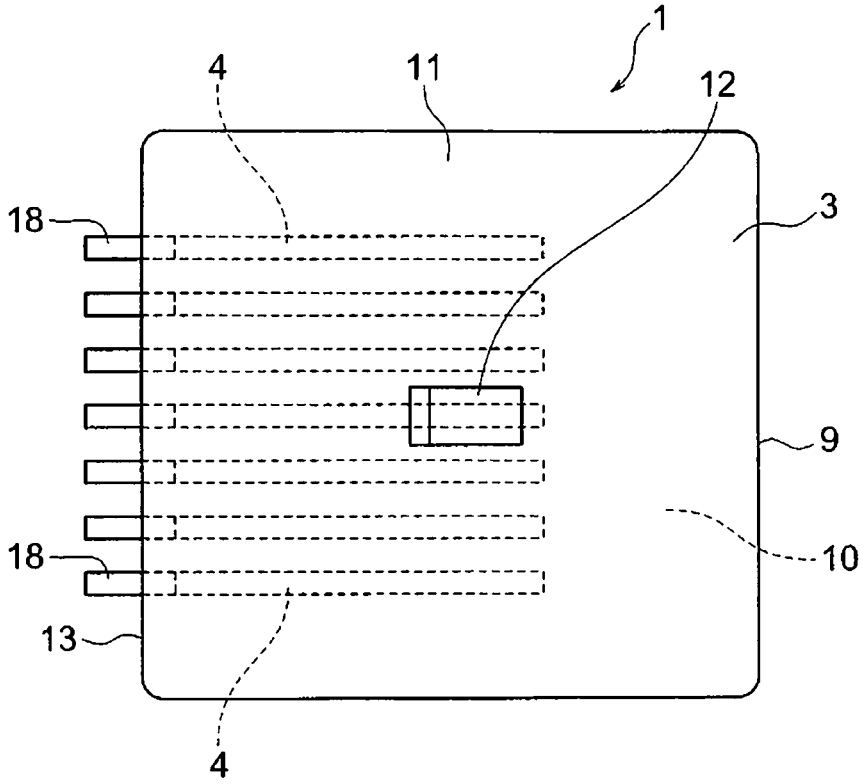
FIG. 3A is a top view of a connector which has clamping terminals.
Figure 3B:
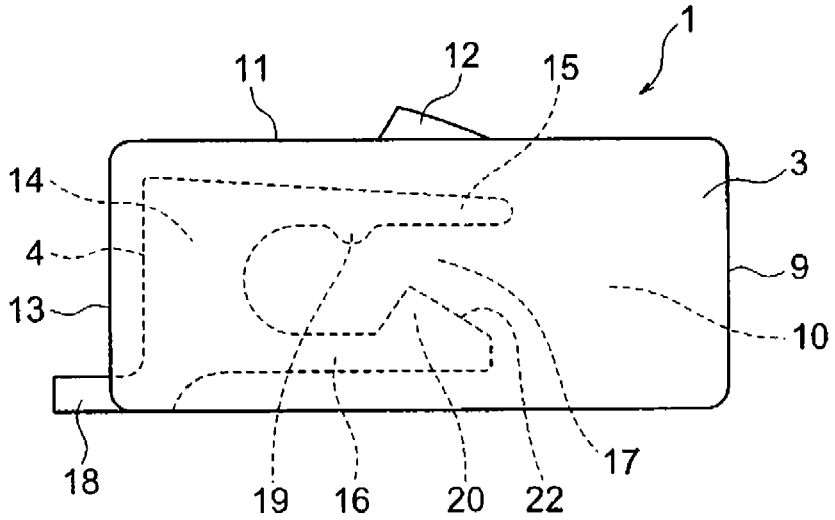
FIG. 3B is a side view of the connector which has the clamping terminals.
Figure 4A:
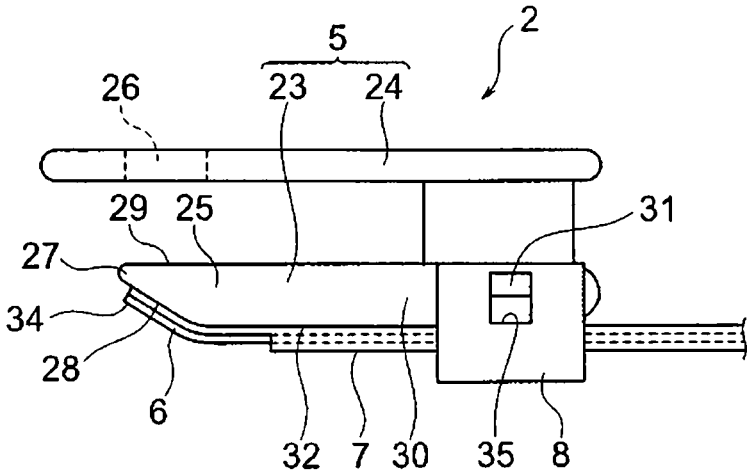
FIG. 4A is a side view of a slider in a state of fixing a circuit body.
Figure 4B:
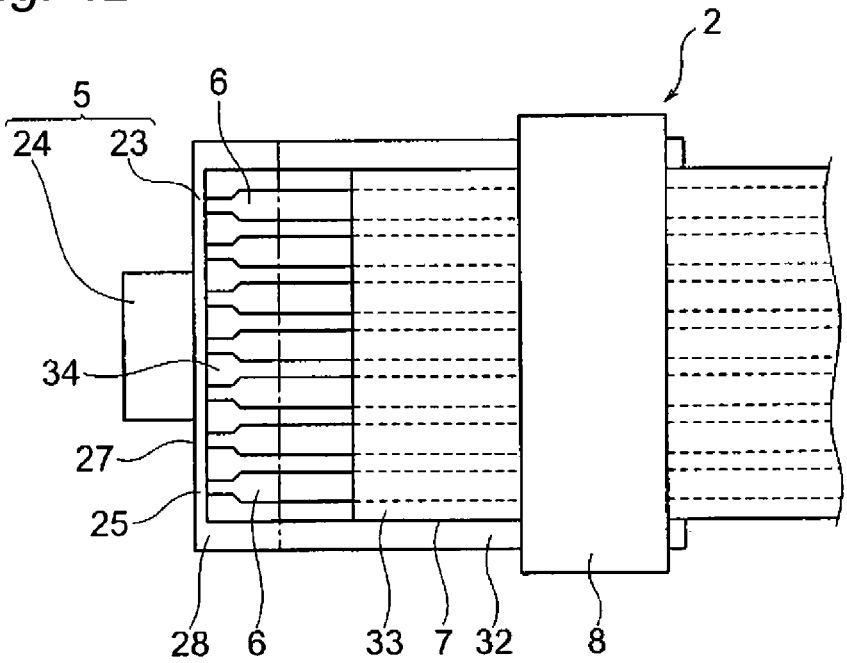
FIG. 4B is a bottom view of the slider in the state of fixing the circuit body.

Next, a first embodiment is described with reference to the figures. FIG. 1 is a configuration figure which shows a connector structure of the present invention. FIG. 2A is a figure which shows an electric connection state, and FIG. 2B is a figure of a connecting slope part. FIG. 3A is a top view of a connector which has clamping terminals, and FIG. 3B is a side view of the connector which has clamping terminals. FIG. 4A is a side view of a slider in a state of fixing a circuit body, and FIG. 4B is a bottom view of the slider in a state of fixing the circuit body.

In FIG. 1, a reference sign 1 shows a female connector which is mounted to a circuit board which is not shown in the figure. A reference sign 2 shows a FPC assembly which is fitted into the female connector 1. The female connector 1 is constructed by including a female housing 3 (a housing) made of synthetic resin which has insulativity, and a plurality of clamping terminals 4 which have conductivity and which is accommodated and fixed into the female housing 3. On the other hand, the FPC assembly 2 (an insertion member) is constructed by including a slider 5 made of synthetic resin which has insulativity, a FPC 7 (a circuit body) which has a plurality of conductors 6, and a holder 8 which is locked to the slider 5 so that the FPC 7 is pressed. First, the above components are described.

In FIGS. 1, 3A and 3B, the female housing 3 is formed into a rectangular box shape in this embodiment. A fitting part 10 is formed so that the front face 9 of the female housing 3 opens. The fitting part 10 is formed as a portion where the clamping terminals 4 are accommodated. Further, the fitting part 10 is formed as a portion where the FPC assembly 2 is inserted.

The female housing 3 has a locking claw part 12 at an approximately central position of a top surface 11 of the female housing 3. The locking claw part 12 is formed to project from the top surface 11 in a roughly claw-like shape. The locking claw part 12 is formed so that the FPC assembly 2 can be locked. The female housing 3 is formed so that a part of the clamping terminals 4 are exposed from the rear surface 13 of the female housing 3.

The female housing 3 is formed so that a length in a front-rear direction of the female housing 3 becomes shorter than that of conventional female housings. That is, the female housing 3 is downsized. This downsizing is realized by adopting the following construction and structure, and of course, it is necessary to downsize the clamping terminals 4 in the above-mentioned front-rear direction.

In FIGS. 1 to 3B, the clamping terminals 4 are formed by forging a metal plate which has conductivity and has a predetermined thickness. The clamping terminals 4 are formed into a female terminal shape. The clamping terminal 4 has a terminal base 14, a first terminal part 15 and a second terminal part 16 which respectively project from the upper end and lower end of the terminal base 14, an insertion space 17 which is formed between the first terminal part 15 and the second terminal part 16, and a board connecting part 18 which is exposed from the rear surface 13 of the female housing 3, and is formed into an illustrated shape.

The first terminal part 15 arranged at the upper part and the second terminal part 16 arranged at the lower part have elasticity which makes the positions of the front ends (free ends) of the first terminal part 15 and the second terminal part 16 may be further separated slightly. Among the first terminal part 15 and the second terminal part 16, a positioning protrusion 19 is protruded and formed at a mid-position of the first terminal part 15. On the other hand, a connecting protrusion 20 is protruded and formed at a front end position of the second terminal part 16. The positioning protrusion 19 and the connecting protrusion 20 are arranged and formed to be protruded to the insertion space 17, respectively.

The positioning protrusion 19 is formed as a portion which determines the insertion position of the FPC assembly 2. The positioning protrusion 19 is formed to function as a so-called stopper. Since the positioning protrusion 19 is located at the mid-position of the first terminal part 15 as described above, the positioning protrusion 19 is arranged and formed behind the connecting protrusion 20 in the front-rear direction. The part from the front end of the first terminal part 15 to the positioning protrusion 19 is formed as a pressing and holding surface part 21 which presses and holds the inserted portion of the FPC assembly 2.

The connecting protrusion 20 is formed as a contacting portion with the conductor 6 in the FPC 7. The connecting protrusion 20 is formed so that a contact area with the conductor 6 can be increased. The connecting protrusion 20 is formed into a convex shape viewed from side. In this embodiment, the convex shape viewed from side is set to have a gentle slope and a steep slope. The gentle slope is arranged and formed to follow from the front end of the second terminal part 16. The gentle slope is formed as a connecting slope part 22.

The connecting slope part 22 is a portion which increases the above-mentioned contact area, and is formed to become a surface which is inclined with respect to the above-mentioned front-rear direction. In particular, the connecting slope part 22 is formed to be inclined in accordance with a fixing slope part 28 to be described of the FPC assembly 2 (The connecting slope part 22 is formed to be parallel with the fixing slope part 28 when the FPC assembly 2 is inserted). The connecting slope part 22 is formed into a plane as shown in FIG. 2B (Another example is described in an second embodiment).

The clamping terminal 4 is formed so that since it is not necessary to largely separate the front end positions of the first terminal part 15 and the second terminal part 16, and the contact area with the conductor 6 of the FPC 7 can be increased at the front end position, the distance from the terminal base 14 to the positioning protrusion 19 can be shortened. Therefore, the clamping terminal 4 is formed so that the dimension L becomes shorter than before.

In FIGS. 1, 4A and 4B, the slider 5 has a slider body 23 and a lock arm part 24 unified with the slider body 23. The slider body 23 is formed as a portion which is inserted in the fitting part 10 of the female housing 3. The front end part (insertion front end part 25) of the slider body 23 is formed as a portion which is inserted in the insertion space 17 of the clamping terminal 4. On the other hand, the lock arm part 24 is formed into a cantilever arm shape which has flexibility. A lock hole 26 formed in the lock arm part 24 is caught to and locked with the locking claw part 12 of the female housing 3. The lock arm part 24 is formed as a portion which serves to prevent falling-out of the slider 5 and maintain an electric connection state.

The insertion front end part 25 has a positioning abutment 27, a fixing slope part 28, and a pressed and held surface part 29, and is formed into an illustrated shape. The positioning abutment 27 is arranged and formed at a position of the front end and top surface of the slider body 23. The positioning abutment 27 is formed as a portion which abuts against the positioning protrusion 19 of the clamping terminal 4. When the positioning abutment 27 of the slider body 23 abuts against the positioning protrusion 19 of the clamping terminal 4, the insertion will be regulated.

The fixing slope part 28 is formed to become a surface which is inclined with respect to the insertion direction of the FPC assembly 2 (the same as the above-mentioned front-rear direction). In this embodiment, the fixing slope part 28 is formed as a gentle slope which follows the positioning abutment 27 and turns to an obliquely downward direction. The pressed and held surface part 29 is formed on the top surface of the slider body 23 as a portion which is pressed and held by the first terminal part 15 of the clamping terminal 4. The pressed and held surface part 29 is arranged and formed to follow the positioning abutment 27.

The slider body 23 has lock projections 31 on two side surfaces 30 of the slider body 23. The lock projection 31 is formed into a roughly claw shape so that the holder 8 can be locked. The bottom surface 32 and the fixing slope part 28 of the slider body 23 are formed as a fixing surface with respect to the FPC 7.

The FPC 7 is a publicly known flexible printed circuit object (Flexible Printed Circuit), and becomes a kind of circuit body applicable to the present invention. The FPC 7 has a plurality of conductors 6 located in parallel in a cross line equally at a predetermined interval, and an insulator 33. The FPC 7 is machined so that the conductors 6 are exposed at the front end part 34. The front end part 34 where the conductors 6 are exposed is formed as a portion which is fixed to the fixing slope part 28 of the slider body 23. As an example, the fixing may be made by attaching with adhesive tape or the like.

A well-known FFC (flexible flat circuit body), a ribbon wire or the like may be mentioned as circuit bodies applicable in addition to the FPC 7. In the present invention, the circuit bodies shall not be limited to the above, as long as the circuit body can be electrically connected with the clamping terminal 4 while it is possible to fix to the slider body 23.

The holder 8 is included as a member for holding the FPC 7 which is fixed to the bottom surface 32 of the slider body 23 (or a component for fixing the FPC 7 to the bottom surface 32 of the slider body 23). Locking hole parts 35 which are caught and locked to the lock projections 31 of the slider body 23 are formed at both sides (left and right sides) of the holder 8.

Next, based on the above-mentioned construction and structure, the assembly and electric connection of the female connector 1 and the FPC assembly 2 are described.

The assembling of the female connector 1 is completed by accommodating a plurality of clamping terminals 4 in the fitting part 10 of the female housing 3. The assembling of the FPC assembly 2 is completed by locking the holder 8 while the FPC 7 is fixed on the fixing slope part 28 and the bottom surface 32 of the slider body 23.

Then, the electric connection is also completed when the fitting is performed so that the FPC assembly 2 is made to slide to the female connector 1. In particular, while the slider body 23 in a state that the FPC 7 is fixed is inserted in the fitting part 10 of the female housing 3, if the insertion front end part 25 of the slider body 23 is inserted between the first terminal part 15 and the second terminal part 16 of the clamping terminal 4, and the insertion is performed until the following state, the electric connection is completed. That is, if the insertion is performed until the positioning abutment 27 of the insertion front end part 25 abuts against the positioning protrusion 19 of the first terminal part 15, at this time, the conductor 6 of the FPC 7 in a state of being fixed to the fixing slope part 28 is in a surface contact with the connecting slope part 22 of the second terminal part 16, and, thereby, the electric connection is completed.

The insertion front end part 25 of the slider body 23 receives the press from the first terminal part 15 with the above-mentioned insertion. Therefore, the surface contact state of the conductor 6 and the connecting slope part 22 is maintained. The lock hole 26 of the lock arm part 24 in the slider 5 is caught to and locked with the locking claw part 12 of the female housing 3. Therefore, the falling out of the FPC assembly 2 is regulated and the surface contact state of the conductor 6 and the connecting slope part 22 is maintained.

As described above with reference to FIGS. 1 to 4B, according to the present invention, since the connector structure has the fixing slope part 28 and the connecting slope part 22 which are inclined with respect to the insertion direction of the FPC assembly 2, and since in the connector structure the conductor 6 exposed from the FPC 7 is fixed to the fixing slope part 28, the conductor 6 of the FPC 7 can be made to be in a good surface contact with the connecting slope part 22 of the clamping terminal 4 with the insertion of the slider 5 in the FPC assembly 2. The contact area can be increased sufficiently.

According to the present invention, since the connector structure has the fixing slope part 28 and the connecting slope part 22 which are inclined with respect to the insertion direction of the FPC assembly 2, the female housing 3 and the clamping terminals 4 can be formed to be shorter than before in the above-mentioned insertion direction.

Therefore, according to the present invention, an effect is achieved that a connector structure can be provided which makes it possible to downsize while the contact area for electric connection can be ensured.

Figure 5A:
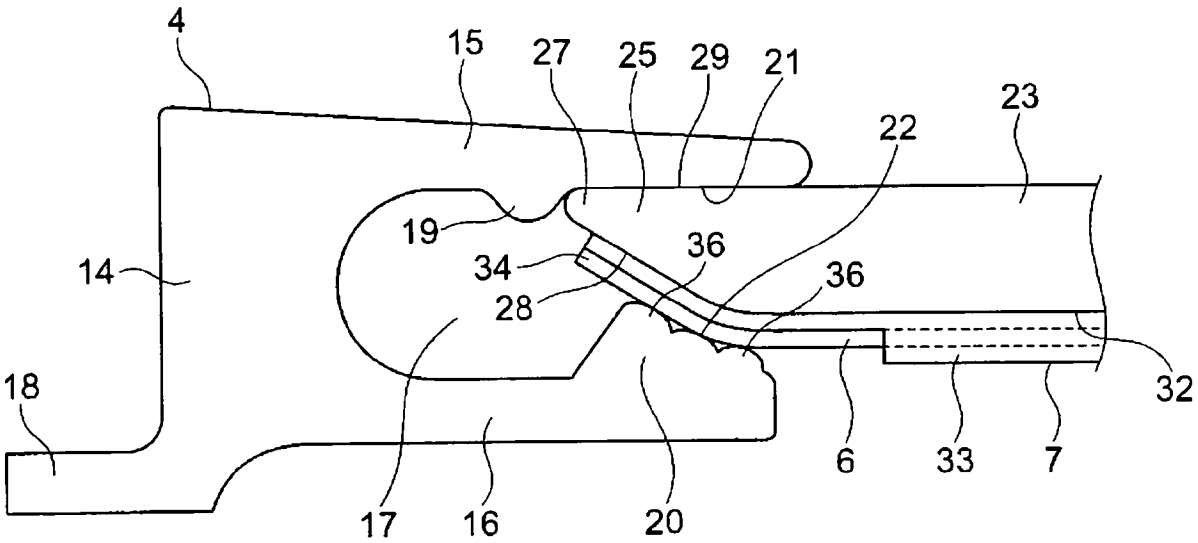
FIGS. 5A and 5B show another example of the connector structure of the present invention (a second embodiment).
Figure 5B:
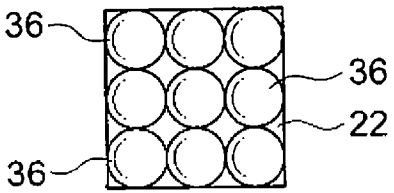

Next, a second embodiment is described with reference to the figures. FIGS. 5A and 5B show another example of the connector structure of the present invention, in which FIG. 5A is a figure which shows an electric connection state, and FIG. 5B is a figure of a connecting slope part. Furthermore, the components that are identical with those in the above-mentioned first embodiment are given identical numbers, and their detailed description is omitted.

In FIGS. 5A and 5B, the second embodiment differs from the above-mentioned first embodiment only in the connecting slope part 22. That is, a plurality of projections 36 are formed on the connecting slope part 22. The projections 36 are formed into a roughly hemispherical shape, but the projections 36 shall not be limited to this. For example, a planar top part may be formed in the projection. If a lot of contacts can be ensured, the shape, number, arrangement or the like shall not be particularly limited.

According to the present invention in the second embodiment, the conductor 6 exposed from the FPC 7 is in a surface contact with the connecting slope part 22 of the connecting protrusion 22 with the insertion the FPC assembly 2. At this time, microscopically, many contact parts are ensured by the plurality of projections 36 formed on the connecting slope part 22.

Therefore, like the first embodiment, the second embodiment achieves an effect that a connector structure can be provided which makes it possible to downsize while the contact area for electric connection can be ensured.

Although the connector structures of the present invention are described with reference to the specific embodiments in detail, it is apparent that various modifications can be made to the invention without changing the purpose of the invention and appropriate variations and amendments are possible. This application is based on the Japanese patent application (patent application 2010-190480) filed on Aug. 27, 2010, whose content is incorporated herein by way of reference.

INDUSTRIAL APPLICABILITY

According to the connector structure of the present invention, a connector structure can be provided which makes it possible to downsize while the contact area for electric connection can be ensured.

REFERENCE SIGNS LIST

1 female connector
2 FPC assembly (insertion member)
3 female housing (housing)
4 clamping terminal
5 slider
6 conductor
7 FPC (circuit body)
8 holder
9 front surface
10 fitting part
11 top surface
12 locking claw part
13 rear surface
14 terminal base
15 first terminal part
16 second terminal part
17 insertion space
18 board connecting part
19 positioning protrusion
20 connecting protrusion
21 pressing and holding surface part
22 connecting slope part
23 slider body
24 lock arm part
25 insertion front end part
26 lock hole
27 positioning abutment
28 fixing slope part
29 pressed and held surface part
30 side surface
31 lock projection
32 bottom surface
33 insulator
34 front end part
35 locking hole
36—projection

The invention claimed is:

1. A connector structure comprising:

a clamping terminal including a first terminal part and a second terminal part which project from a terminal base, and an insertion space which is formed between the first terminal part and the second terminal part;

a housing including a fitting part which accommodates the clamping terminal;

an insertion member configured to be inserted into the insertion space through the fitting part; and a circuit body, fixed to the insertion member, and configured to be electrically connected to one of the first terminal part and the second terminal part in a state where the insertion member is inserted into the insertion space, wherein the insertion member is formed with a fixing slope part, which is inclined with respect to an insertion direction, at a front end part of the insertion member in the insertion direction, a conductor exposed from the circuit body is fixed to the fixing slope part, a connecting protrusion is formed on one of the first terminal part and the second terminal part, and the connecting protrusion is formed with a connecting slope part which is inclined in accordance with the fixing slope part.

2. The connector structure according to claim 1, wherein the connecting slope part is formed with a plurality of projections.

3. The connector structure according to claim 1, wherein a positioning protrusion is formed on the other one of the first terminal part and the second terminal part, and the positioning protrusion is located at a position farther than the connecting slope part with respect to the insertion member.

4. The connector structure according to claim 2, wherein a positioning protrusion is formed on the other one of the first terminal part and the second terminal part, and the positioning protrusion is located at a position farther than the connecting slope part with respect to the insertion member.

* * * * *